US009193505B2

(12) United States Patent
Kosub, Sr. et al.

(10) Patent No.: US 9,193,505 B2
(45) Date of Patent: Nov. 24, 2015

(54) RECLOSABLE PACKAGE OR BAG WITH AUDIBLE RECLOSURE

(71) Applicant: Minigrip LLC, Seguin, TX (US)

(72) Inventors: Roy Kosub, Sr., Seguin, TX (US); David Lee Hall, San Antonio, TX (US); Jacob Arriaga, Seguin, TX (US); Richard Lee Bell, Seguin, TX (US); James E. Cheatham, Seguin, TX (US); Victor H. Ramirez, San Marcos, TX (US); Armando Barajas Guerrero, Seguin, TX (US)

(73) Assignee: MINIGRIP, LLC, Seguin, TX (US)

( * ) Notice: Subject to any disclaimer, the term of this patent is extended or adjusted under 35 U.S.C. 154(b) by 0 days.

(21) Appl. No.: 13/892,979

(22) Filed: May 13, 2013

(65) Prior Publication Data

US 2015/0158637 A1 Jun. 11, 2015

(51) Int. Cl.

| | |
|---|---|
| ***B65D 33/25*** | (2006.01) |
| ***A44B 19/42*** | (2006.01) |
| ***B26D 3/08*** | (2006.01) |

(52) U.S. Cl.

CPC ..... *B65D 33/255* (2013.01); *A44B 19/42* (2013.01); *B26D 3/08* (2013.01); *B65D 33/2558* (2013.01); *Y10T 24/2534* (2015.01)

(58) Field of Classification Search

CPC ..... A44B 19/14; A44B 18/004; A44B 19/42; B65D 33/25; B65D 2203/12; B65D 33/255; B65D 33/2558; Y10T 24/2534; B26D 3/08

See application file for complete search history.

(56) References Cited

U.S. PATENT DOCUMENTS

| | | | | |
|---|---|---|---|---|
| 2,867,001 | A | | 1/1959 | Lewis et al. |
| 2,895,170 | A | | 7/1959 | Carlile et al. |
| 4,479,244 | A | | 10/1984 | Ausnit |
| 4,586,319 | A | | 5/1986 | Ausnit |
| 5,070,584 | A | | 12/1991 | Dais et al. |
| 5,138,750 | A | | 8/1992 | Gundlach et al. |
| 5,140,727 | A | * | 8/1992 | Dais et al. ..... 24/400 |
| 5,259,904 | A | | 11/1993 | Ausnit |
| 5,307,552 | A | * | 5/1994 | Dais et al. ..... 29/453 |
| 5,363,540 | A | | 11/1994 | Dais et al. |
| 5,478,228 | A | | 12/1995 | Dais et al. |
| 5,617,770 | A | | 4/1997 | May |
| 5,640,744 | A | | 6/1997 | Allan |
| 5,647,100 | A | | 7/1997 | Porchia et al. |
| 5,878,468 | A | | 3/1999 | Tomic et al. |
| 5,962,040 | A | | 10/1999 | Dais et al. |
| 6,021,557 | A | * | 2/2000 | Dais et al. ..... 29/453 |
| 6,594,872 | B2 | | 7/2003 | Cisek |
| 6,692,147 | B2 | | 2/2004 | Nelson |
| 6,955,465 | B2 | | 10/2005 | Machacek et al. |
| 7,137,736 | B2 | | 11/2006 | Pawloski et al. |
| 7,886,412 | B2 | | 2/2011 | Dais et al. |
| 8,469,593 | B2 | | 6/2013 | Price et al. |

(Continued)

*Primary Examiner* — Robert J Sandy

(74) *Attorney, Agent, or Firm* — McCarter & English, LLP

(57) ABSTRACT

The present disclosure relates a reclosure or zipper for a reclosable package or container, such as a plastic bag, wherein opening or closing the zipper causes an audible sound and a tactile feel. The reclosure or zipper is manufactured by an apparatus which includes a cutting wheel which is opposed to a pressure wheel. The cutting wheel includes cutting teeth spaced about its periphery. Interlocked zipper material is engaged between the cutting wheel and the pressure wheel to form indentations in the interlocked zipper, thereby resulting in audible and tactile feedback when the zipper is operated.

9 Claims, 6 Drawing Sheets

(56) References Cited

U.S. PATENT DOCUMENTS

| | | | | |
|---|---|---|---|---|
| 8,568,031 | B2 | 10/2013 | Price et al. | |
| 8,578,572 | B2 | 11/2013 | Ackerman et al. | |
| 8,727,620 | B2 | 5/2014 | Dais et al. | |
| 2007/0280563 | A1 | 12/2007 | Ausnit | |
| 2011/0044566 | A1 | 2/2011 | Fish et al. | |
| 2012/0106875 | A1* | 5/2012 | Pawloski | 24/400 |
| 2012/0106876 | A1* | 5/2012 | Pawloski | 24/400 |

* cited by examiner

RECLOSABLE PACKAGE OR BAG WITH AUDIBLE RECLOSURE

BACKGROUND OF THE DISCLOSURE

1. Field of the Disclosure

The present disclosure relates to a reclosure or zipper for a reclosable package or container, such as a plastic bag, wherein opening or closing the reclosure or zipper causes an audible sound and a tactile feel.

2. Description of the Prior Art

In the prior art, it is known to deform male zipper profiles to produce a zipper which will produce audible and tactile feedback during opening and closing operations by the user. Examples of such prior art can be found in U.S. Pat. No. 6,594,872 entitled "Interlocking Closure Device", issued to Cisek on Jul. 22, 2003; U.S. Pat. No. 5,962,040 entitled "Apparatus for Making a Zipper for a Reclosable Thermoplastic Bag", issued to Dais et al. on Oct. 5, 1999; U.S. Pat. No. 5,878,468 entitled "Closure Arrangement for Reclosable Bag and Method Thereof", issued to Tomic et al. on Mar. 9, 1999; U.S. Pat. No. 5,647,100 entitled "Closure Member for a Reclosable Thermoplastic Bag", issued to Porchia et al. on Jul. 15, 1997; U.S. Pat. No. 5,478,228 entitled "Apparatus for Making a Zipper for a Reclosable Thermoplastic Bag" issued to Dais et al. on Dec. 26, 1995; U.S. Pat. No. 5,138,750 entitled "Zipper for Reclosable Thermoplastic Bag", issued to Gundlach et al. on Aug. 18, 1992; U.S. Pat. No. 5,070,584 entitled "Zipper for a Reclosable Thermoplastic Bag and a Process and Apparatus for Making", issued to Dais et al. on Dec. 10, 1991.

An audible or clicking plastic zipper is known in the prior art. However, the use of deformations to make the sound and feel to mimic a metal zipper has involved manufacturing steps on the zipper with the zipper halves separated from each other. In the blown film process, this requires the extra manufacturing steps of opening or separating the zipper so that it can be deformed, and then closing or interlocking it again.

OBJECTS AND SUMMARY OF THE DISCLOSURE

It is therefore an object of the present disclosure to provide a zipper and a method of manufacturing thereof, wherein the deformations required for producing audible and tactile feedback during the operation of the zipper are produced while the zipper halves are engaged or interlocked with each other.

This and other objects are attained by providing a cutting wheel for cutting clicker impressions, wherein the cutting wheel is journaled for rotation by roller bearings on a common shaft that is held by a T-shaped yoke on linear bearings. This unit follows a path guided by the material zippers. A pressure roller is applied from the male side of the material while the cutting wheel is applied on the female side of the material, or vice versa. The clicker impression wheels are applied toward the pressure roller, trapping the interlocked profiles/zippers in between the pressure roller and the clicker/impression wheels, thereby creating a visual pattern on the zipper and likewise resulting in a zipper which will produce audible and tactile feedback during operation.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
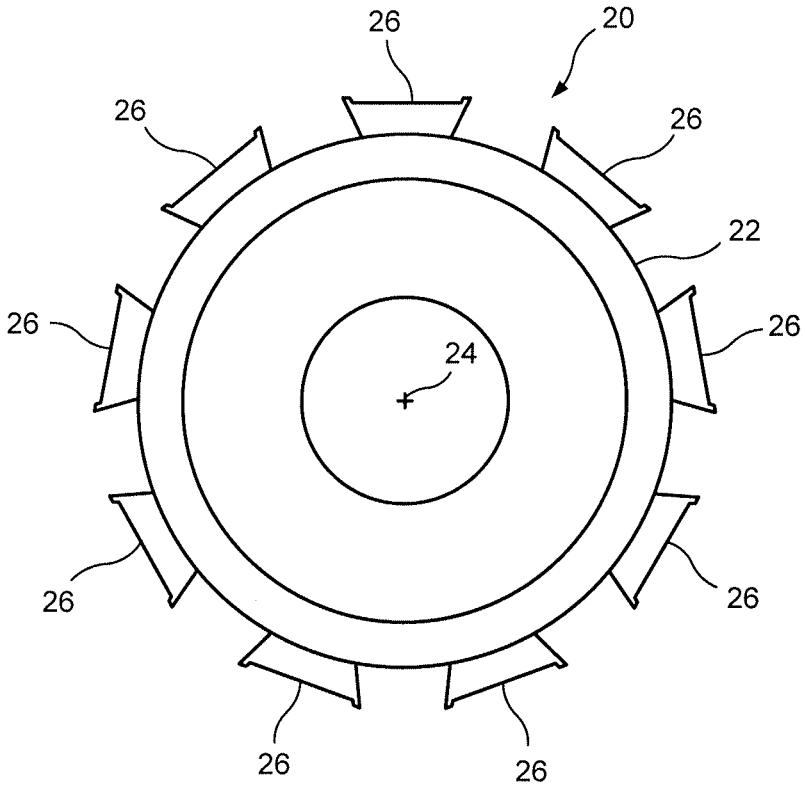
FIG. 1 is an end plan view of an embodiment of the cutting wheel of the present disclosure.
Figure 2:
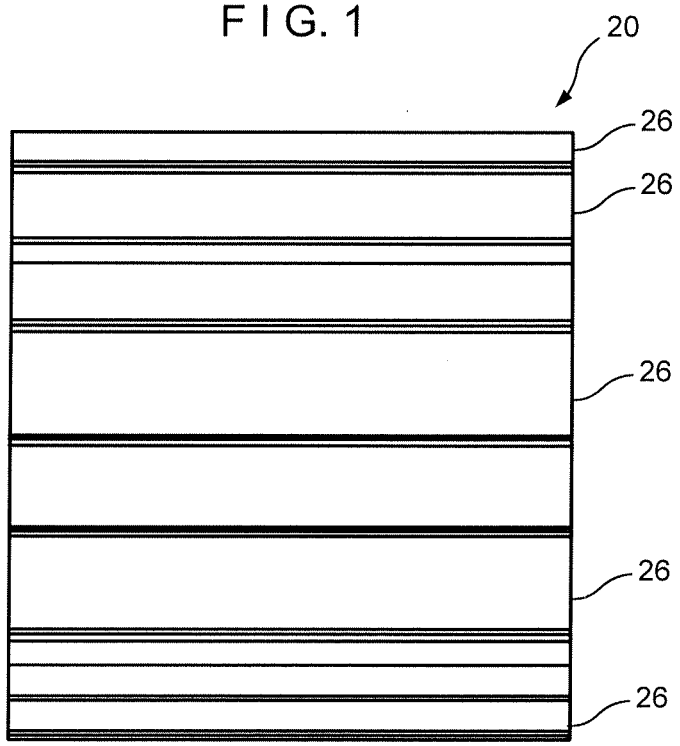
FIG. 2 is a side plan view of an embodiment of the cutting wheel of the present disclosure.
Figure 3:
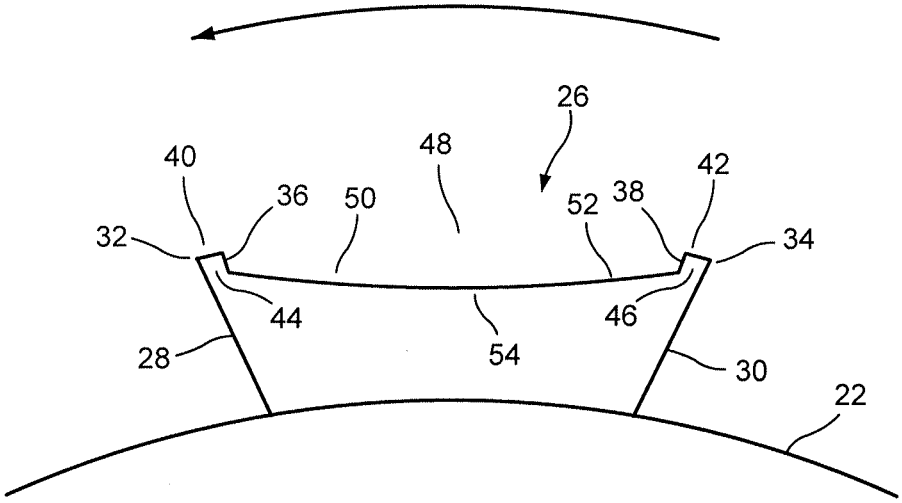
FIG. 3 is a side plan view showing the details of the teeth of the cutting wheel of the present disclosure.

Referring now to the drawings in detail wherein like numerals indicate like elements throughout the several views, one sees that FIGS. 1 and 2 are end and front plan views, respectively, of cutting wheel 20, which is typically made of metal or similar material. Cutting wheel 20 has a generally cylindrical outline as defined by outer cylindrical peripheral surface 22 and is journaled for rotation about rotational axis 24. Cutting teeth 26 are spaced periodically along the cylindrical peripheral surface 22 and extend outwardly therefrom. A single cutting tooth 26 is illustrated in further detail in FIG. 3. The cutting tooth 26 is bounded by leading and trailing radially oriented edges 28, 30 thereby defining a leading edge of start tooth 32 and a trailing edge of end tooth 34 ("leading", "trailing", "start" and "end" being determined by illustrated direction of rotation). The trailing edge 36 of start tooth 32 and the leading edge 38 of end tooth 34 form bounding surfaces which make the distal ends 40, 42 of start tooth 32 and end tooth 34, respectively, have a greater expanse than the proximal ends 44, 46 of the start tooth 32 and end tooth 34, respectively. This relationship is formed by the inward extension of edges 36, 38 intersecting with the respective radii formed by the inward extension of leading and trailing radially oriented edges 28, 30 prior to the inward extension of the leading and trailing radially oriented edges 28, 30 intersection with the rotational axis 24 (see FIG. 1). This resulting configuration of start tooth 32 and end tooth 34 is designed to retain the lead-in of start tooth 32 and retain the lead-out of end tooth 34 during operation of cutting wheel 20. Arcuate region 48 is formed between start tooth 32 and end tooth 34. Adjacent to start tooth 32 is initial radial area 50 of arcuate region 48 to deform the profiles of the closed zipper. Likewise, adjacent to end tooth 34, is ending radial area 52 of arcuate region 48 to deform the profiles of the closed zipper. Between initial and ending radial areas 50, 52, at a central location of cutting tooth 26, is the maximum depth 54 of arcuate region 48.

Figure 4:
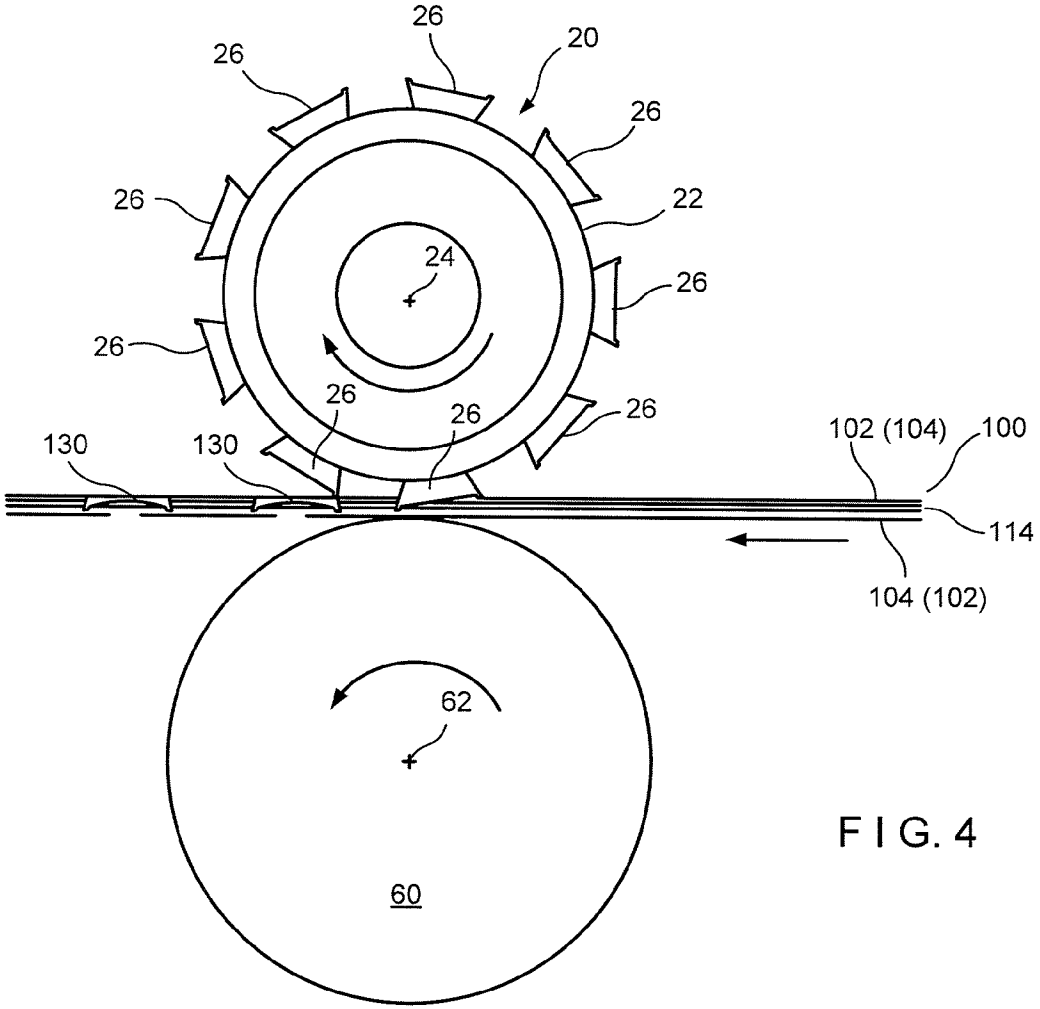
FIG. 4 is a side plan view of the cutting wheel of the present disclosure engaging a reclosable plastic package or bag.
Figure 6:
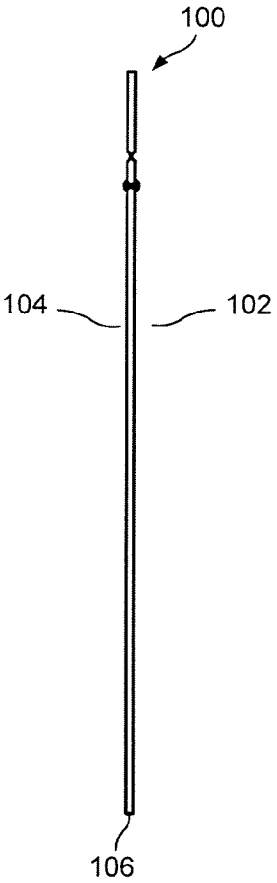
FIG. 6 is a cross-sectional view along plane 6-6 of FIG. 5.
Figure 5:
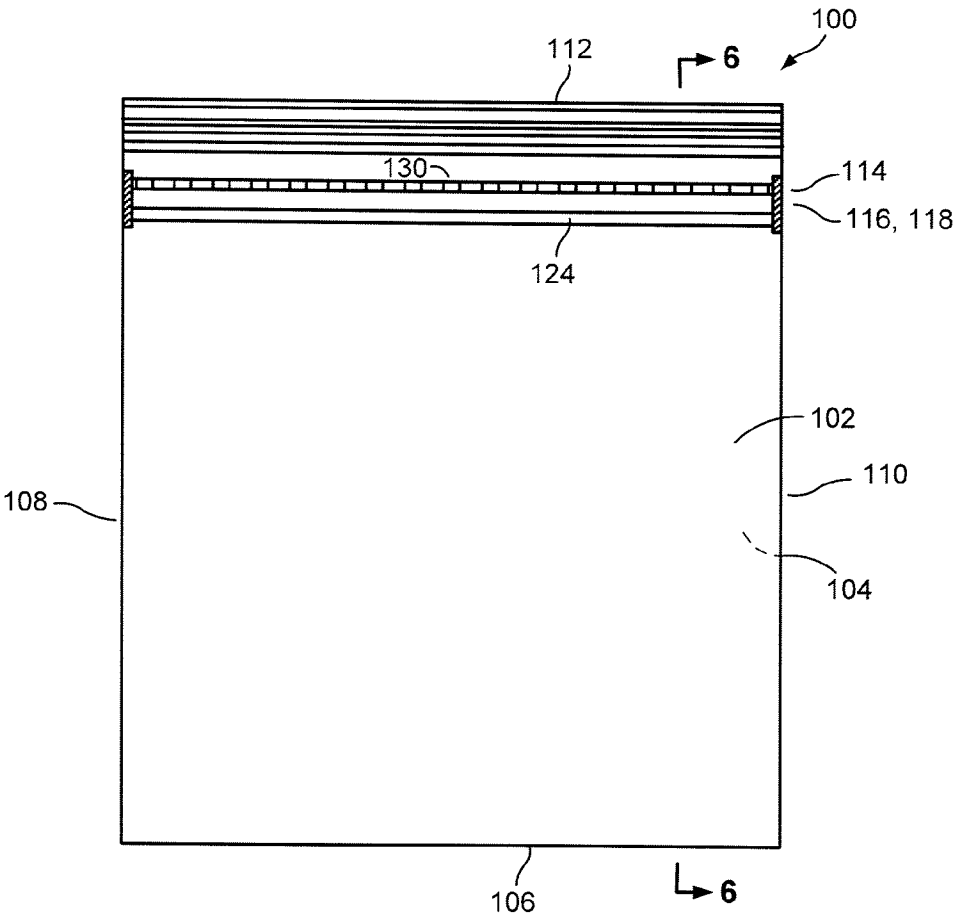
FIG. 5 is a front plan view of a plastic package or bag upon which the cutting wheel of the present disclosure has been applied.
Figure 8:
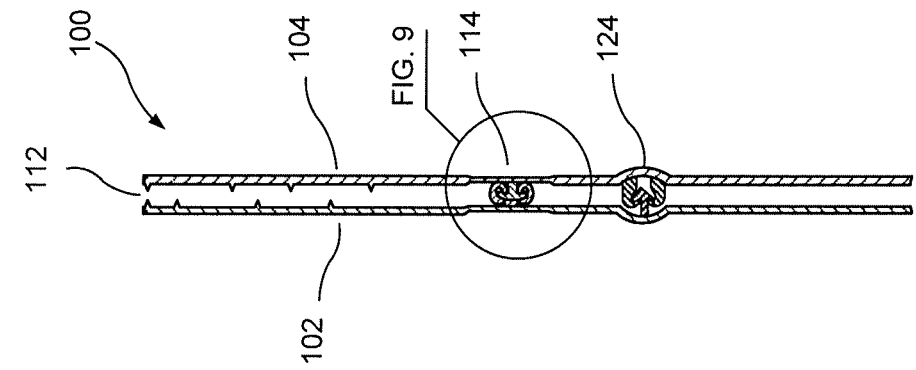
FIG. 8 shows a portion of FIG. 6 in greater detail.
Figure 7:
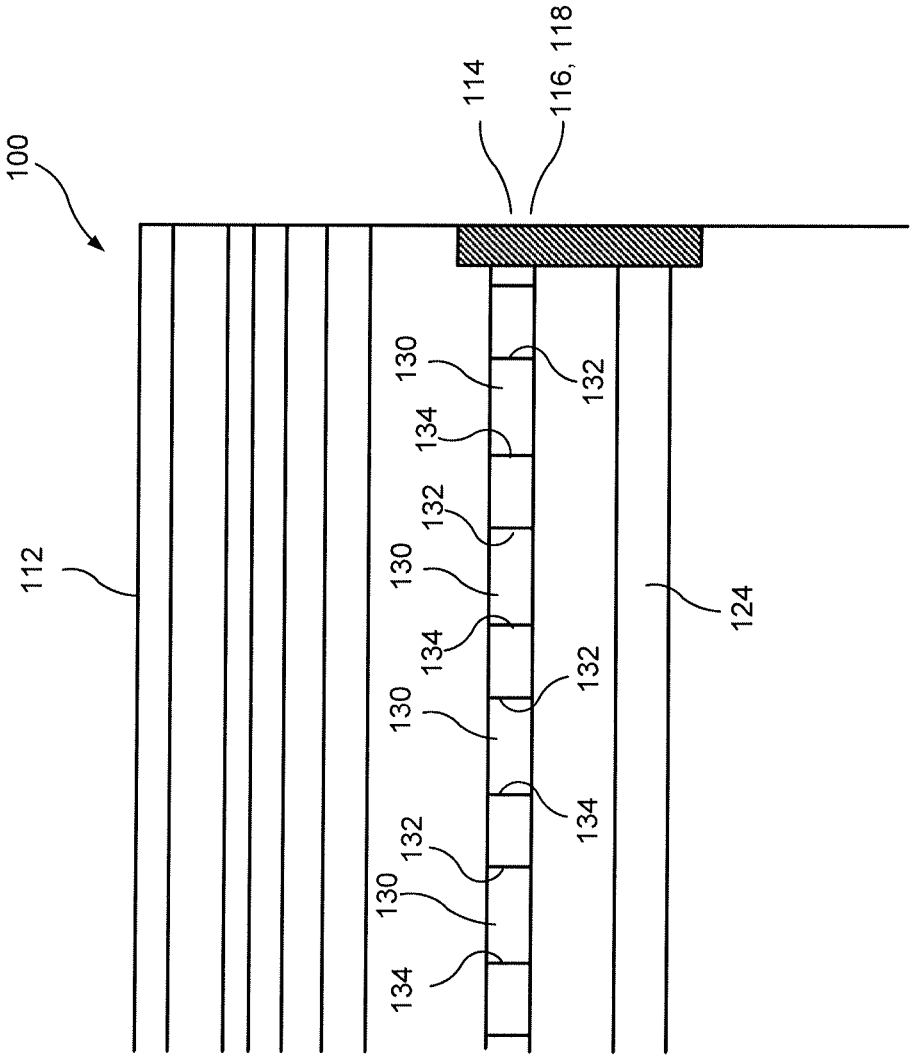
FIG. 7 shows a portion of FIG. 5 in greater detail.
Figure 9:
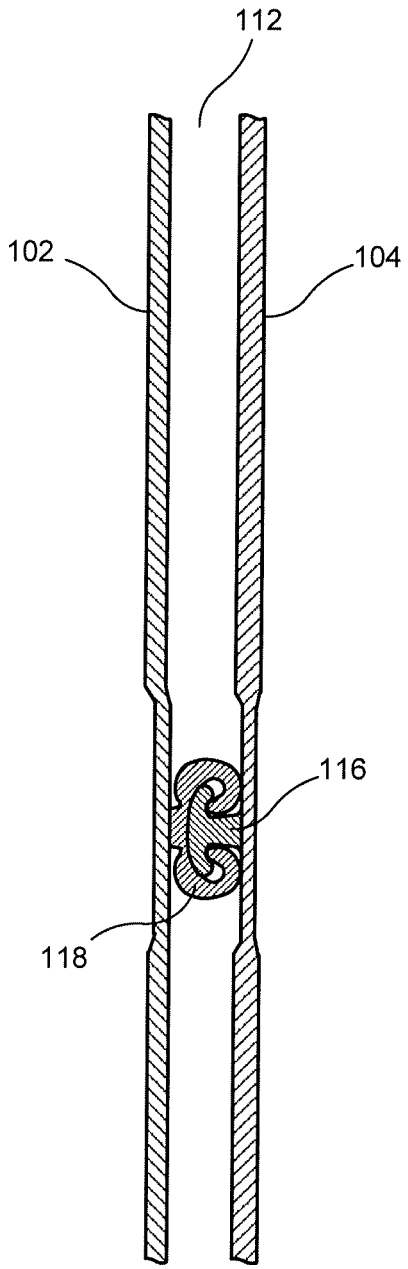
FIG. 9 shows a portion of FIG. 6 in further greater detail.

As shown in FIG. 4, cutting wheel 20 typically rotates about longitudinal rotational axis 24 which stays in place. Cutting wheel 20 is positioned to be opposed to pressure roller 60, which likewise rotates about stationary rotational axis 62 and engages reclosable container or bag 100 (also see FIGS. 5-9, and the description thereof) between cutting wheel 20 and pressure roller 60 (in an alternative embodiment, only the zipper 114 is placed between the cutting wheel 20 and the pressure roller 60). The profiles 116, 118 of the zipper 114 are interlocked with each other and engaged between the cutting wheel 20 and pressure roller 60. The reclosable container or bag 100 is illustrated as moving toward the left of FIG. 4, thereby rotating the cutting wheel 20 over the zipper 110 of the reclosable container or bag 100, resulting in the cutting teeth 26 forming successive crescent-shaped impressions 130, including notches 132, 134 as formed by the start tooth 32 and end tooth 34, in the bag wall 102 or 104, immediately over and extending into one of the zipper profiles 116, 118. It can further be seen from FIG. 4 how the maximum depth 54 of arcuate region 48 determines how far the start tooth 32 and end tooth 34 impinge into the reclosable container or bag 100 as, typically, the walls 102 or 104 have minimal deformation at the point of contact with the area of maximum depth 54 of arcuate region 48.

The resulting reclosable container or bag 100 is shown in FIGS. 4-9. Reclosable bag or container 100 includes coextensive first and second planar walls 102, 104, typically of polymeric material, which are sealed together at the edges by bottom seal 106 and side seals 108, 110 thereby forming mouth 112, which is made reclosable by zipper 114 which extends the width of reclosable package or container 100 and includes male profile 116 (sealed or otherwise attached to second wall 104) which is engaged within female profile 118 (sealed or otherwise attached to first wall 102). The illustrated embodiment discloses the crescent-shaped impressions 130, including notches 132, 134, being formed immediately over and extending into the female profile 118 (wall 102 above wall 104 in the illustrated configuration of FIG. 4). However, it is likewise envisioned that some embodiments could have the crescent-shaped impressed 130 being formed immediately over and extending into the male profile 116 (wall 104 above wall 102 in the illustrated configuration of FIG. 4). Further, it is likewise envisioned that the operation illustrated in FIG. 4 could be performed twice—once so that the cutting wheel 20 impinges upon the male profile 116 and another time so that the cutting wheel impinges upon the female profile 118 (or vice versa). FIGS. 4-9 are illustrated with an optional secondary zipper 124 (which may be implemented as secondary interlocking elements formed integrally with zipper 114) on the product side of zipper 114.

The resulting reclosable container or bag 100 includes a row of notches 132, 134, formed from crescent-shaped impressions 130, which extends into at least one profile 116, 118, or both profiles 116, 118, of the zipper 114. That is, the crescent-shaped impressions 130 of FIGS. 5 and 7 could be formed on one or both sides of reclosable bag or container 100 and zipper 114. This configuration, particularly with the resulting deformation of at least one profile 116, 118, results in tactile and audible feedback during operation (i.e., interlocking or separating the profiles 116, 118) of the zipper 114. This configuration further results in an enhanced appearance of the reclosable container or bag.

Further advantages achieved include increased efficiency in manufacturing; increased tactile and audible feedback due to distortion and impression on both the male and female profiles; and reduced required machinery modification as the zipper typically does not have to be opened and closed to apply the distortion.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper for a reclosable package or bag, which generates audible and tactile feedback during operation, including a first interlocking profile and a second interlocking profile, wherein the zipper is manufactured by a method including the steps of:

providing a cylindrical cutting wheel rotating about a first longitudinal axis, the cylindrical cutting wheel including a plurality of cutting teeth around a periphery thereof, wherein each cutting tooth includes a leading tooth and a trail tooth, the leading tooth rotating ahead of the trailing tooth, each cutting tooth further including an arcuate crescent-shaped element between the leading tooth and the trailing tooth;

providing a pressure roller rotating about a second longitudinal axis, the pressure roller being opposed to the cutting wheel;

placing the zipper with the first and second profiles interlocked together between the cutting wheel and the pressure roller; and operating the cutting wheel to form crescent-shaped indentations in the interlocked zipper.

2. The zipper of claim 1 wherein, in the method of manufacture thereof, the first longitudinal axis remains in a fixed position during operation.

3. The zipper of claim 2 wherein, in the method of manufacture thereof, the second longitudinal axis remains in a fixed position during operation.

4. The zipper of claim 3 wherein, in the method of manufacture thereof, distal surfaces of the leading tooth and trailing tooth are broader than proximal surfaces thereof.

5. The zipper of claim 3 wherein, in the method of manufacture thereof, the arcuate element defines a maximum level of penetration of the leading tooth and the trailing tooth.

6. The zipper of claim 1 wherein the first profile is a male profile and the second profile is a female profile.

7. The zipper of claim 6 wherein, in the method of manufacture thereof, the cutting wheel impinges upon the male profile.

8. The zipper of claim 7 wherein, in the method of manufacture thereof, the cutting wheel impinges upon the female profile.

9. The zipper of claim 7 wherein, in the method of manufacture thereof, the step of operating the cutting wheel includes the step of operating the cutting wheel so as to impinge upon the male profile and further includes the step of operating the cutting wheel so as to impinge on the female profile.

* * * * *